US005620674A

United States Patent [19]

Yamamoto et al.

[11] Patent Number: 5,620,674

[45] Date of Patent: Apr. 15, 1997

[54] CARBON FIBERS AND PROCESS FOR THEIR PRODUCTION

[75] Inventors: Iwao Yamamoto; Hiroyuki Aikyo, both of Yokohama, Japan

[73] Assignee: Mitsubishi Chemical Corporation, Tokyo, Japan

[21] Appl. No.: 327,818

[22] Filed: Oct. 17, 1994

Related U.S. Application Data

[63] Continuation of Ser. No. 4,541, Jan. 14, 1993, abandoned.

[30] Foreign Application Priority Data

Jan. 14, 1992 [JP] Japan ..... 4-024653
Jan. 28, 1992 [JP] Japan ..... 4-037287

[51] Int. Cl.[6] ..... B01F 9/12

[52] U.S. Cl. ..... 423/447.2

[58] Field of Search ..... 423/447.1, 447.2; 428/367, 368

[56] References Cited

U.S. PATENT DOCUMENTS

| | | | |
|---|---|---|---|
| 4,032,430 | 6/1977 | Lewis | 423/447.1 |
| 4,197,283 | 4/1980 | Crépaux et al. | 423/447.1 |

FOREIGN PATENT DOCUMENTS

| | | | |
|---|---|---|---|
| 0245035 | 11/1987 | European Pat. Off. . | |
| 349307 | 1/1990 | European Pat. Off. | 423/447.2 |
| 0426438 | 5/1991 | European Pat. Off. . | |
| 2532322 | 3/1984 | France . | |

*Primary Examiner*—Michael Lewis
*Assistant Examiner*—Stuart L. Hendrickson
*Attorney, Agent, or Firm*—Oblon, Spivak, McClelland, Maier & Neustadt, P.C.

[57] ABSTRACT

A carbon fiber having a fiber diameter of at least 15 μm, a tensile modulus of elasticity of more than 104 ton/mm$^2$ and a spread L of graphite crystallites in the direction of axis a of at least 1,000 Å as determined from the powder X-ray spectrum.

4 Claims, 1 Drawing Sheet

CARBON FIBERS AND PROCESS FOR THEIR PRODUCTION

This application is a continuation of application Ser. No. 08/004,541, filed on Jan. 14, 1993, now abandoned.

The present invention relates to carbon fibers and a process for their production. The carbon fibers of the present invention exhibit a remarkably high modulus of elasticity by themselves or, when graphitized at a high temperature, will give carbon fibers having a remarkably high modulus of elasticity. The carbon fibers having such a high modulus of elasticity are useful as materials for space ships, materials for aircrafts, materials for sporting goods, materials for vehicles, materials for general industrial machines, materials for buildings, etc. for which a light weight and high rigidity are required.

High performance carbon fibers are generally classified into PAN-type carbon fibers prepared from polyacrylonitrile (PAN) as starting material and pitch-type carbon fibers prepared from pitches as starting material, and they are widely used as e.g. materials for aircrafts, materials for sporting goods and materials for buildings, by virtue of their characteristics such as high specific strength and high specific modulus of elasticity, respectively.

However, for the application as structural materials for e.g. space ships for which a light weight and high rigidity are required, carbon fibers having a higher modulus of elasticity are required, and many studies have been conducted to attain 104 ton/mm$^2$ as the so-called theoretical modulus of elasticity of graphite, which has been believed to be a limiting value of the modulus of elasticity of carbon fibers (O. L. Blakslee et al., Journal of Applied Physics, 41 3373 (1970)).

However, the tensile modulus of elasticity of commercially available PAN-type carbon fibers is usually less than 65 ton/mm$^2$.

On the other hand, it is generally believed that a high modulus of elasticity may be accomplished more easily with pitch-type carbon fibers where graphitization can be developed readily as compared with PAN-type carbon fibers, but the tensile modulus of elasticity of commercially available pitch-type carbon fibers is usually less than 91 ton/mm$^2$. Recently, it has been reported that carbon fibers having a tensile modulus of elasticity of 100 ton/mm$^2$ at the highest, can be prepared by controlling the orientation angle and the size of domain of pitch fibers (Japanese Unexamined Patent Publication No. 161524/1991 ).

Although, carbon fibers having a tensile modulus of elasticity close to the so-called theoretical modulus of elasticity of graphite have been developed as mentioned above, such a modulus of elasticity is not yet necessarily adequate for every application, and carbon fibers having a still higher modulus of elasticity i.e. even a modulus of elasticity higher than the so-called theoretical modulus of elasticity, are desired.

As a result of extensive studies to solve the above problem, the present inventors have found it possible to obtain carbon fibers having a modulus of elasticity which is at least the so-called theoretical modulus of elasticity of graphite and which, in some cases, surprisingly far exceeds the theoretical modulus of elasticity, by conducting infusible treatment under a specific condition during the production of the carbon fibers, so that only the central portion of the carbon fibers is melt-carbonized so that the graphite crystal structure develops more than the peripheral portion, and consequently, the average spread La of the entire carbon fibers will be at least 1,000 Å. The present invention has been accomplished on the basis of this discovery.

Namely, it is an object of the present invention to provide carbon fibers which exhibit a remarkably high modulus of elasticity by themselves or which, when carbonized or graphitized at a high temperature, will give carbon fibers having a remarkably high modulus of elasticity.

Such an object of the present invention can readily be accomplished by:

a carbon fiber having a fiber diameter of at least 15 μm, a tensile modulus of elasticity of more than 104 ton/mm$^2$ and a spread L of graphite crystallites in the direction of axis a of at least 1,000 Å as determined from the powder X-ray spectrum;

a carbon fiber which provides such a large La and a high modulus of elasticity, when carbonized or graphitized at a temperature of at least 3,000° C.; and a process for producing a carbon fiber, which comprises subjecting a fiber obtained by spinning a pitch to infusible treatment, carbonization and/or graphitization, wherein the infusible treatment is conducted under such condition that only the peripheral portion is infusibilized and the center portion is not infusibilized so that it will be melt-carbonized in the carbonization and/or graphitization step, and the diameter of the resulting carbon fiber is at least 15 μm.

Now, the present invention will be described in detail.

Figure 1:
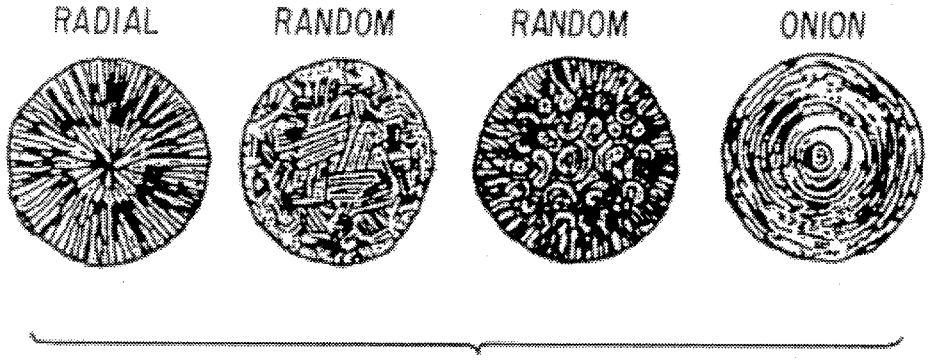
FIG. 1 shows diagrammatical views of cross-sections of carbon fibers having various tissue structures wherein the respective center portions underwent melting and carbonization.

There is no particular restriction as to the spinning pitch to be used for the present invention to obtain the carbon fiber, so long as it is capable of presenting an optically anisotropic carbon fiber and it has readily orientable molecular species formed therein.

The carbonaceous material to be used to obtain such spinning pitch, may, for example, be coal-type coal tar, coal tar pitch, a liquefied product of coal, petroleum-type heavy oil, tar, pitch or a polymerization reaction product of naphthalene or anthrathene obtained by a catalytic reaction. These carbonaceous materials contain impurities such as free carbon, unsoluble coal, an ash content and a catalyst. It is advisable to preliminarily remove such impurities by a conventional method such as filtration, centrifugal separation or sedimentation separation by means of a solvent.

Further, the carbonaceous material may be subjected to pretreatment, by e.g. a method wherein after heat treatment, a soluble content is extracted with a certain specific solvent, or a method wherein it is hydrogenated in the presence of a hydrogen donative solvent or hydrogen gas.

In the present invention, it is advisable to employ carbonaceous material which contains at least 40%, preferably at least 70%, more preferably at least 90%, of an optically anisotropic structure. For this purpose, the above-mentioned carbonaceous material may be heat-treated usually at a temperature of from 350° to 500° C., preferably from 380° to 450° C., for from 2 minutes to 50 hours, preferably from 5 minutes to 5 hours, in an atmosphere of an inert gas such as nitrogen, argon or hydrogen, or while blowing such an inert gas, as the case requires.

In the present invention, the proportion of the optically anisotropic structure of pitch is the proportion of the area of the portion showing optical anisotropy in a pitch sample, as observed by polarization microscope at room temperature. Specifically, for example, a pitch sample pulverized to a particle size of a 10 mm is embedded on substantially the entire surface of a resin with a diameter of 2 cm by a conventional method, and the surface is polished. Then, the entire surface is observed under a polarization microscope (100 magnifications), whereby the proportion of the area of the optically anisotropic portion in the entire surface area of the sample is measured.

Such a meso phase pitch is spun by a conventional method to obtain a pitch fiber. At that time, it is preferred to conduct spinning under such a condition that the viscosity of the pitch at the outlet of the nozzle will be low within a range where no fiber breakage or pulsation will take place, in order to promote the orientation of the pitch molecules in the direction of fiber axis.

The fiber diameter of the resulting fiber can be controlled by adjusting the discharge speed from the nozzle and the winding up speed during the spinning. The carbon fiber of the present invention has a feature that the fiber diameter is at least 15 μm, preferably from 15 to 50 μm, more preferably from 18 to 40 μm, whereby a carbon fiber having a high modulus of elasticity can be obtained. To obtain a carbon fiber having such a specific fiber diameter, a pitch fiber may be prepared by spinning taking into consideration a shrinkage of the fiber diameter at a level of from 20 to 30% during the carbonization and/or graphitization.

To the pitch fiber thus obtained, infusible treatment is applied to obtain an infusible fiber. For the infusible treatment, an optional conventional method for infusible treatment may be employed such as a method of heating a pitch fiber in an oxidizing gas such as air, oxygen, ozone or nitrogen dioxide, or a method of dipping the pitch fiber in an oxidizing liquid such as nitric acid. However, the condition for such infusible treatment is required to be set so that in the subsequent carbonization or graphitization step, only the center portion of the infusible fiber will be melted and carbonized, i.e. only the peripheral portion of the pitch fiber will be infusibilized. For example, in the method wherein the pitch fiber is heated in air for infusible treatment, it is possible to infusibilize only the peripheral portion of the pitch fiber by adjusting the heating condition to a lower temperature and/or a shorter period of time than the usual infusible treatment. Otherwise, the infusible treatment may be conducted in an atmosphere having a lower oxidizing nature than air without changing the time or the temperature. The specific condition varies depending upon the type of the starting material pitch and the diameter of spun fiber. Therefore, in the actual operation, a condition under which only the peripheral portion of the pitch fiber is infusibilized, will be properly selected.

The infusible fiber thus obtained, is baked in an inert gas such as nitrogen or argon gas at a temperature necessary for carbonization or graphitization, to obtain a carbon fiber. During the carbonization step, the center portion of the infusible fiber, which is not fully infusibilized, will be thermally melted, while the peripheral portion will not be melted, whereby the central portion undergoes liquid phase carbonization, while the peripheral portion undergoes solid phase carbonization. In general, the physical properties and characteristics of carbon material are governed by the structure of crystallites evaluated by a size at a level of from 10 Å to 1,000 Å and the structure of agglomerates of such crystallites i.e. a tissue structure evaluated by a size of a level of from 0.1 μm to 100 μm (Fundamentals of Chemical Engineering of Carbon, edited by Sugiro Otani and Yuzo Sanada, published by Ohm Company (1980) 130). When liquid phase carbonization and solid phase carbonization are compared, in the liquid phase carbonization, a meso phase is carbonized in a molten state while being rearranged, whereby both graphite crystallites and the tissue structure will be enlarged. Accordingly, the carbon fiber obtainable by the present invention has a structure in which the center portion of the fiber will have a tissue structure far developed and substantially larger than the peripheral portion, and when baked at a temperature of at least 3,000° C., the graphite crystal will also be large, and the spread La in the direction of axis a will reach to a level of at least 1,000 Å. With respect to the tissue structure of pitch-type carbon fibers having a high modulus of elasticity, a radial type, a random type and an onion type have been known, and it is said that the tissue structure depends on the flow of pitch during spinning (Carbon Fibers, edited by Sugiro Otani et al., Kindai Henshu (1983) 197). The carbon fiber obtained by the present invention will have a structure as shown in FIG. 1 wherein the tissue structure of the center portion is larger than the peripheral portion, since the center portion is melted and carbonized during the carbonization step by adopting a specific condition for infusible treatment. The difference in the graphite crystallinity between the center portion and the peripheral portion of the fiber can be confirmed by measuring the center portion and the peripheral portion of the fiber cross-section, for example, by a μ-Raman spectrometry.

Further, the tissue structure of the central portion of the fiber formed by such liquid phase carbonization can be confirmed by observing the cross-section vertical to the longitudinal direction of the fiber by a scanning electron microscope by properly enlarging it to a level of from 4,000 to 10,000 magnifications depending upon the fiber diameter. At the center portion of the fiber, there is a laminated tissue structure having a length of at least 0.4 to 2 μm in a bent or folded form, and the size of the tissue structure is at least twice on an average in the length or the thickness of the laminated portion as compared with the size of the tissue structure of the peripheral portion of the fiber. Further, the portion having such a large tissue structure at the central portion of the fiber, constitutes from 4 to 90% of the entire cross-sectional area of the fiber. A usual carbon fiber takes a route of solid carbonization, whereby rearrangement of atoms is suppressed, and the bent or folded tissue structure is fine. Whereas, the carbon fiber of the present invention has a structural feature that since the central portion undergoes liquid carbonization during the carbonization step, in the cross-sectional structure, the bent or folded structure of the center portion of the carbon fiber is very large as compared with the bent or folded structure of the peripheral portion of the carbon fiber.

Thus, the carbon fiber of the present invention can be obtained as described above. The higher the baking temperature during the carbonization and graphitization treatment, and the longer the time for baking during the carbonization and graphitization treatment, the more the development of the graphite crystallinity proceeds, whereby a carbon fiber having a high modulus of elasticity can be obtained. The overall crystallinity of the carbon fiber can be evaluated by the spread La of the graphite layer plane as an index.

Now, the present invention will be described in further detail with reference to Examples. However, it should be understood that the present invention is by no means restricted by such specific Examples.

In the Examples, the spread La of the graphite layer plane was obtained from the (110) diffraction of graphite by "Method for Measuring the Lattice Constant and the Size of Crystallites of an Artificial Graphite" (Sugiro Otani et al., Carbon Fibers, published by Kindai Henshu (1983) 701–710) stipulated by the 117th Committee Meeting of Nippon Gakujutsu Shinkokai, and presented as La (110).

The tensile modulus of elasticity was measured by a monofilament test method of JIS R-7601, 1980.

EXAMPLE 1

From coal tar pitch, a meso phase pitch having a proportion of optical anisotropy of 100% as observed under a polarization microscope, was prepared.

This meso phase pitch was spun at a spinning viscosity at the outlet of the nozzle of 360 poise and at a discharge speed of 63 m/min, to obtain a pitch fiber. Here, the pitch fiber diameter was designed to be 30 μm.

This pitch fiber was heat-treated in air at 290° C. for minutes to obtain an infusible fiber. For this infusible treatment, the temperature was raised at a rate of 6° C./min. from room temperature to 100° C., then at a rate of 3° C./min. to 140° C. and finally at a rate of 1° C./min. to 290° C.

This infusible fiber was graphitized in argon gas at 3,250° C. for 25 minutes to obtain a carbon fiber having a fiber diameter of 22.2 μm. For this graphitization, the temperature was raised over a period of 30 minutes from room temperature to 1,000° C. and then at a rate of 20° C./min. to 3,250° C.

This carbon fiber had a La (110) of at least 1,000 and a tensile modulus of elasticity of 122 ton/mm$^2$.

By the observation by means of a scanning electron microscope, the bent or folded tissue structure of laminated graphite network layers at the center portion, was observed to have grown by melt-carbonization to be far large as compared with the peripheral portion.

EXAMPLE 2

An infusible fiber prepared in the same manner as in Example 1, was graphitized in argon gas at 3,250° C. for 25 minutes to obtain a carbon fiber having a fiber diameter of 22.0 μm.

This carbon fiber had a La (110) of at least 1,000 and a tensile modulus of elasticity of 153 ton/mm$^2$.

Figure 2:
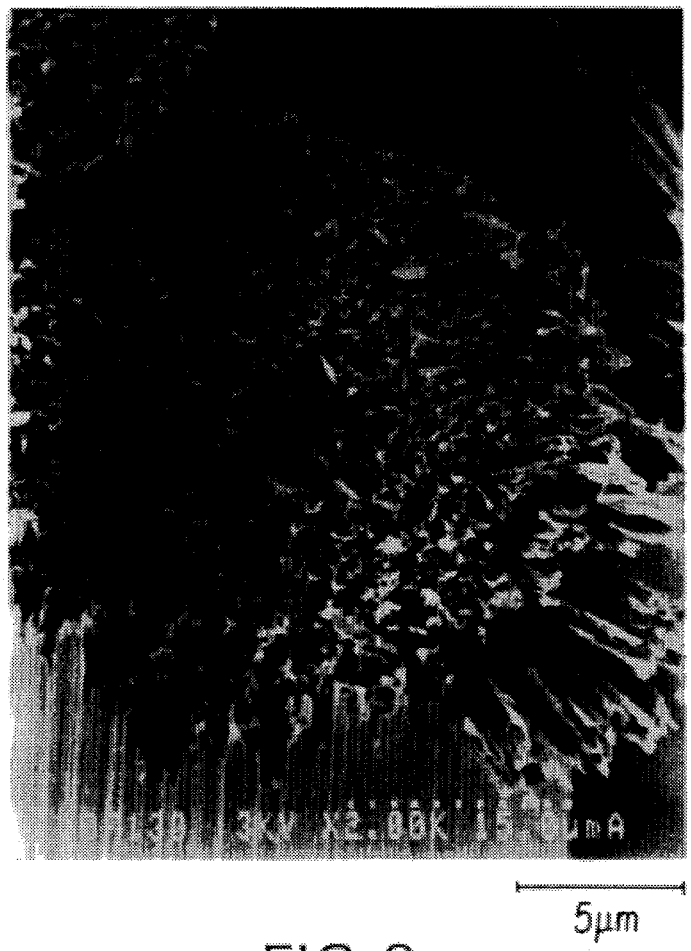
FIG. 2 is a scanning electron microscopic photograph showing a rupture cross-section of the carbon fiber obtained in Example 2.

A scanning electron microscopic photograph of the rupture cross-section of this carbon fiber is shown in FIG. 2. The bent or folded tissue structure of laminated graphite network layers at the center portion of this carbon fiber, was observed to have grown by melt-carbonization to be far large as compared with the peripheral portion.

The Raman spectra of the center portion and the peripheral portion of the rupture cross-section vertical to the direction of fiber axis of this carbon fiber were measured at an exciting wavelength of 488 nm at an exciting output of 20 mW with a beam diameter of 1 μm by means of nR1800 manufactured by Nippon Bunko Kogyo K. K.

From the obtained spectra, a ratio $R=I^{1360}/I^{1580}$ was determined, where $I^{1360}$ is the peak intensity at about 1360 cm$^1$ and $I^{1580}$ is the peak intensity at about 1580 cm$^1$, and La values at the respective measured portions were determined by La (Å)=44/R (F. Tuinstra and J. L. Koenig, J. Chem. Phys. 53(3) 1126–1130 (1970)).

As a result, La at the center portion was 1980 Å, and La at the peripheral portion was 340 Å.

EXAMPLE 3

An infusible fiber prepared in the same manner as in Example 1, was graphitized in argon gas at 3,250° C. for 25 minutes to obtain a carbon fiber having a fiber diameter of 20.7 μm.

This carbon fiber had a La (110) of at least 1,000 and a tensile modulus of elasticity of 195 ton/mm$^2$.

By the observation by means of a scanning electron microscope, the bent or folded tissue structure of laminated graphite network layers at the center portion of this carbon fiber, was observed to have grown by melt-carbonization to be far large as compared with the peripheral portion.

EXAMPLE 4

A carbon fiber was prepared in the same manner as in Example 1 except that the diameter of the obtained carbon fiber was 19.2 μm.

This fiber had a La (110) of at least 1,000 Å and a tensile modulus of elasticity of 125 ton/mm$^2$.

COMPARATIVE EXAMPLE 1

A carbon fiber was prepared in the same manner as in Example 1 except that the diameter of the obtained carbon fiber was 9.4 μm.

This fiber had a La (110) of 510 Å and a tensile modulus of elasticity of 91 ton/mm$^2$.

The cross section of this fiber was observed by a scanning electron microscope, whereby no substantial difference was observed between the center portion and the peripheral portion in the tissue structure, thus indicating that the center portion did not undergo melt-carbonization.

COMPARATIVE EXAMPLE 2

A carbon fiber was prepared in the same manner as in Example 1 except that the diameter of the obtained carbon fiber was 11.0 μm.

This fiber had a La (110) of 590 Å and a tensile modulus of elasticity of 92 ton/mm$^2$.

The carbon fiber of the present invention exhibits a modulus of elasticity which is remarkably higher than conventional carbon fibers and which is at least equal to the so-called theoretical modulus of elasticity of graphite and in some cases, far exceeds the theoretical modulus of elasticity. Thus, it provides a substantial industrial advantage.

We claim:

1. A carbon fiber having a fiber diameter of at least 15 μm, a tensile modulus of elasticity of more than 104 ton/mm$^2$ and a value L of graphite crystallites at least 1000 Å long in the direction of axis a as determined from powder X-ray spectrum.

2. The carbon fiber according to claim 1, wherein the carbon fiber has a center portion and a peripheral portion, wherein each of the peripheral portion and the center portion has a tissue structure of laminated graphite network layers, wherein the tissue structure size of the center portion is larger than the tissue structure size of the peripheral portion.

3. The carbon fiber according to claim 1, wherein the carbon fiber has a center portion and a peripheral portion, wherein each of the peripheral portion and the center portion has a tissue structure of laminated graphite network layers, wherein the tissue structure of laminated graphite network layers of the center portion is in a bent of folded form, wherein the tissue structure size of the center portion is larger than the tissue structure size of the peripheral portion.

4. The carbon fiber of claim 1, wherein said tensile modulus of elasticity is ≦ about 195 tons/mm$^2$.

* * * * *